United States Patent [19]

Kostow

[11] Patent Number: 4,498,671

[45] Date of Patent: Feb. 12, 1985

[54] LOTTO DICE

[76] Inventor: Michael Kostow, 224 Lincoln Ter., Norristown, Pa. 19403

[21] Appl. No.: 492,369

[22] Filed: May 6, 1983

[51] Int. Cl.[3] ..... A63F 7/04

[52] U.S. Cl. ..... 273/144 B

[58] Field of Search ..... 273/144, 146, 138 R, 273/94 R

[56] References Cited

U.S. PATENT DOCUMENTS

| | | | |
|---|---|---|---|
| D. 142,576 | 10/1945 | Morris . | |
| 693,821 | 2/1902 | De Ford . | |
| 1,436,909 | 11/1922 | Roberts . | |
| 1,593,907 | 7/1926 | Madan . | |
| 2,526,123 | 10/1950 | Dawson . | |
| 2,739,815 | 3/1956 | Fay . | |
| 3,074,718 | 1/1963 | Modica . | |
| 3,204,345 | 9/1965 | Buckner . | |
| 3,399,893 | 9/1968 | Payne, Jr. | 273/94 R |
| 3,495,832 | 2/1970 | Thomassen-Behle . | |
| 3,679,212 | 7/1972 | Smith . | |
| 3,785,651 | 1/1974 | Smith . | |
| 3,873,092 | 3/1975 | Fagan | 273/138 R |
| 4,015,850 | 4/1977 | Russell . | |
| 4,148,488 | 4/1979 | Kohlhagen . | |
| 4,164,351 | 8/1979 | Baker . | |
| 4,368,887 | 1/1983 | Gamble | 273/144 B |
| 4,385,763 | 5/1983 | Moscovich | 273/144 B X |

FOREIGN PATENT DOCUMENTS

| | | | |
|---|---|---|---|
| 75700 | of 0000 | Fed. Rep. of Germany . | |
| 801077 | of 0000 | Fed. Rep. of Germany . | |
| 2003826 | 8/1971 | Fed. Rep. of Germany | 273/144 B |
| 607302 | of 0000 | France . | |
| 7500129 | 7/1976 | Netherlands | 273/144 B |
| 1418690 | 12/1975 | United Kingdom | 273/138 R |

*Primary Examiner*—Paul E. Shapiro

*Attorney, Agent, or Firm*—Steele, Gould & Fried

[57] ABSTRACT

A game device for selecting random numbers of a lotto game card grid. In the preferred embodiment the device is a cube with each of the six face members having recessed pockets conforming to the grid positions of lotto numbers. The cube contains a group of balls corresponding in number to the number of lotto card grid numbers to be selected.

8 Claims, 6 Drawing Figures

FIG. 1
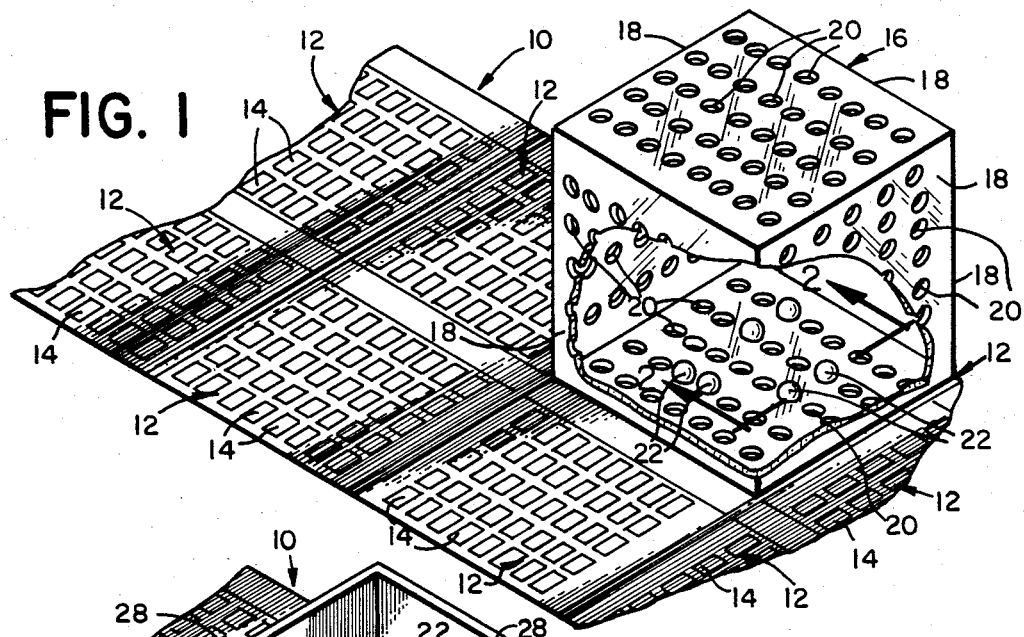
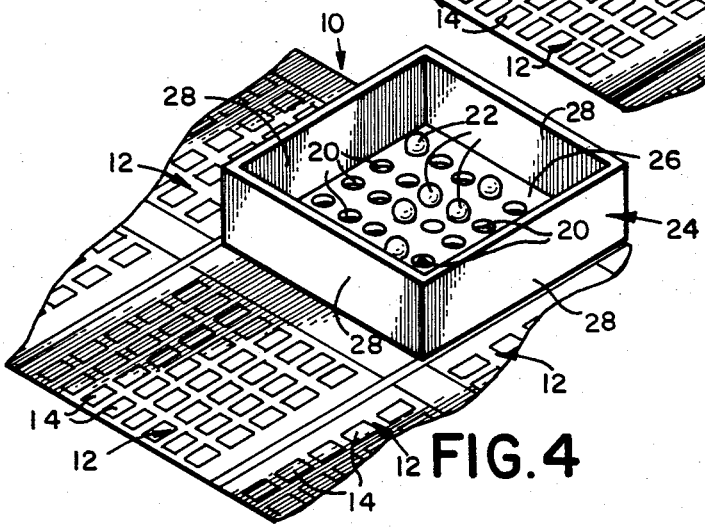
FIG. 4
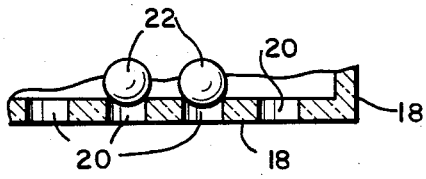
FIG. 2
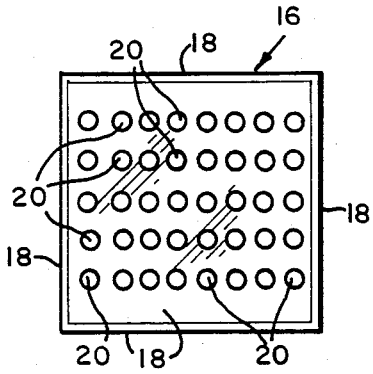
FIG. 3
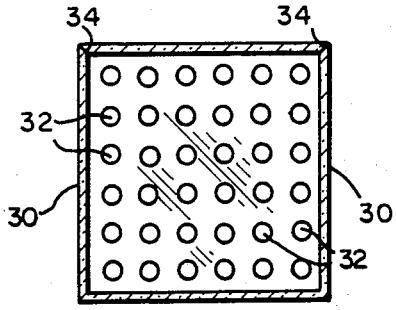
FIG. 5
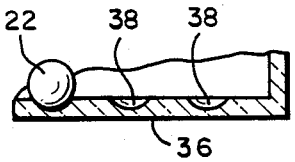
FIG. 6

LOTTO DICE

BACKGROUND OF THE INVENTION

In playing lotto games, players search for ways in which they can be disciplined to randomly select numbers. The typical lotto game may comprise the selection of, as an example, six numbers from a grid pattern of forty. A typical lotto card may have on the order of eight individual game grids. The player may have the option of playing two, four, six or all eight games for different fees.

Most individuals are readily susceptible to favoritism of certain patterns or numbers that for some reason or another have special meaning to them. It therefore becomes difficult for them to make purely random selections which is a desire of many players.

Numerous game devices are known which enable players to select random numbers. These range from rather sophisticated structures such as the dice game device of U.S. Pat. No. 2,526,123 to rather simple devices such as conventional dice which may be rolled repeatedly to select random numbers.

Game devices such as that disclosed in U.S. Pat. No. 693,821 and U.S. Pat. No. 4,164,351 feature self-contained selection elements or ball-type elements, the devices being used to select numbers by being shaken or rolled to rearrange the self-contained elements. While these devices may be helpful in selecting a certain range of random numbers, they do not present in and of themselves a readily-adaptable technique for selecting random numbers of a lotto card type scheme. To use such devices for lotto card selection, if randomness is to be assured, rather complicated choosing schemes must be developed in which repeated rolling of the devices is carried out. Even so, purely random selection is difficult.

SUMMARY OF THE INVENTION

Difficulties in selecting purely random numbers for a lotto card scheme are overcome by use of the subject invention, which is both practical and entertaining to use. In the preferred embodiment, a cube-like device is disclosed with each cube face member having pockets or inwardly facing recesses, which recesses correspond in number and positioning to the grid pattern of each individual lotto game. It is customary in playing each of the lotto games to select a specified number, often six, from the grid pattern which may comprise on the order of forty numbers, numbered from one through forty. In the subject game device, self-contained within the cube will be a group of ball-like objects which will correspond in number to the number of the grid pattern numbers to be selected. If there are six such numbers to be selected, then the device will contain a group of six balls.

Selection of the grid pattern numbers is accomplished by shaking the game device or otherwise agitating the group of balls within, so that the balls are randomly arranged. The lotto card should be sitting on a horizontal surface and once the game device has been shaken or otherwise handled sufficiently to move the balls from previous positions, the device is set upon the grid of the lotto game being played, with the pockets of the downwardly facing side being positioned to correspond with number blocks of the grid pattern of the lotto game. The individual self-contained balls will come to rest in random fashion in certain of the pockets, thus giving the player a quick method of randomly selecting numbers of the grid pattern.

While the same face member of the game device cube may be used repeatedly, different face numbers may be used as well, to set upon the game grid, giving the player another variable in achieving total random selection of the lotto numbers.

Accordingly, it is an object of the present invention to provide a game device useful in the random selection of numbers of a lotto game card.

It is a related object of the present invention to provide a game device which is amusing for the player to use but which nevertheless provides for the random selection of numbers if properly used.

It is a further object of the present invention to provide a game device for use in conjunction with a lotto card which is inexpensive to manufacture yet which may be used repeatedly without danger of destruction.

Other objects and advantages of the present invention will become apparent from the detailed description of the invention taken in conjunction with the accompanying drawings.

BRIEF DESCRIPTION OF THE DRAWINGS

FIG. 1 is a perspective view of the game device, in partial breakaway, taken from above and showing the device resting on the game grid of a lotto card.

FIG. 2 is a cross-section view taken along the lines 2—2 of FIG. 1 and showing balls resting in two of the pockets.

FIG. 3 is a front elevational view of the cube of FIG. 1 showing a face member in detail.

FIG. 4 is a perspective view showing an alternate embodiment of the invention wherein the game device comprises a single face number as contrasted to the six face numbers of the game device cube as shown in FIG. 1.

FIG. 5 is a front elevational view of an alternative embodiment of a game device face member where different face member patterns can be used in a single game device cube.

FIG. 6 is a side elevational view of a further alternative embodiment of a face member showing modified pockets.

DETAILED DESCRIPTION OF THE INVENTION

With reference to FIG. 1, a portion of a lotto card 10 is shown. The lotto card 10 as shown has at least eight individual game grids 12 which are arranged on the card 10. Each game grid 12 is shown having forty individual number blocks 14 arranged in five rows, eight number blocks 14 to a row. In standard lotto card configuration, each number block 14 would contain a number with the numbers arranged in ascending order from one to forty.

It is to be understood that the lotto card 10 does not form a part of the subject invention but rather is to be a standard type card as used by many of the states for their state lotteries. For example, the configuration shown in FIG. 1 of having eight games per card with number blocks one through forty arranged in five rows of eight number blocks per row is used by the State of Pennsylvania. Other states may have different configurations but the game devices as described herein can be constructed so as to be used with different grid patterns commonly used by the various states.

In a standard type state lottery game, lotto is played by the player selecting a certain number of the number blocks of each game and hoping that his selected numbers correspond to the numbers ultimately picked at a subsequent drawing. In the case of the Pennsylvania card, the payment of $1.00 enables the playing of two games on the card while the payment of each additional dollar allows the playing of two additional games up to the playing of all eight card games for the payment of $4.00.

With further reference to FIG. 1, the game device 16 is shown to be a cube having six sides or face members 18. Each face member 18 has pockets 20 which, as shown, are drilled holes in the face members 18.

As best seen in FIG. 2, the drilled holes become pockets 20 to balls 22 since the holes are of smaller diameter than the balls 22, thus allowing the balls to be received, in part, by pockets 20.

With further reference to FIG. 1, the pockets 20 are arranged in a grid pattern identical to the patterns of the individual game grids 12 of the lotto card 10. As shown in FIG. 1, each of the face members 18 has the same grid pattern as the game grids 12 of the lotto card 10, i.e., arrangement of pockets in five rows of eight pockets per row (see FIG. 3).

With further reference to FIG. 1, a group of six balls 22 is shown self-contained within the game device 16, the number of balls corresponding to the number of number blocks to be chosen by the lotto player under the rules of the lotto game.

The game device 16 of FIG. 1 is constructed of transparent plastic face members 16 which may be secured to one another by epoxy once the balls are placed within. The pockets 20 may be formed by drilling through the face member 18 under the condition that the drill holes be of less diameter than the balls 22 to be used. The balls 22 may be metallic in composition and constructed on the order of BB's. They may be perfectly balanced or they may be weighted to roll in unpredictable patterns and further increase the amusement of the game device.

The game device 16 is utilized by shaking or otherwise moving the device to cause the balls 22 to roll about freely within the structure until the game device 16 is placed onto one of the game grids 12 of the lotto card 10. The balls 22 will then roll into certain of the pockets 20 giving a random selection of the numbers appearing in the number blocks 14 of the lotto card game grid 12 beneath. The numbers of number blocks 14 thus selected are noted and blackened or otherwise marked once the game device 16 is lifted. For the next game grid 12 to be played, either the same face member 18 may be used or another one of the six face members 18 may be selected by placing it to be the bottom of the game device cube 16. In this way, numbers of the lotto blocks 14 are selected randomly in an amusing fashion by use of the game device 16.

An alternate embodiment of the present invention is disclosed in FIG. 4. The game device 24 is shown comprising a single face member 26 instead of the six face members 18 of game device 16. The face member 26, including pockets 20 may be identical to face member 18 of game device 16 and the balls 22 identical with those used in game device 16. Game device 24 has four sides 28 to prevent the balls 22 from rolling off of face member 26. Game device 24 is used in identical manner to game device 16 except that the player only has the option of using one face member 26 instead of the six face members 18 of game device 16.

As shown in FIG. 5, face member 30 has pockets 32 arranged in a pattern of six by six totalling thirty-six pockets. Different state lotteries have different patterns of different numbers of number blocks and the pattern as shown in face member 30 is representative of such a different configuration. Face member 30 may be substituted in game device 16 to give the player the option of using the same game device on different state lottery cards that utilize different configurations. Further, such substitutions are also contemplated. As also shown in FIG. 5, face member 30 may be constructed with beveled corners 34 which will correspond to mating construction of other face members. Such construction will enable one of the members to be friction fitted and thus securable to the other members without the need of epoxy. With such construction, the removable face member may be removed to change the number of balls in the event that different state lotteries using different configurations also use different numbers of number blocks to be selected.

As shown in FIG. 6, the side of a face member 36 which can be substituted for any of the face members 18, 26, 30, is shown having pockets 38 formed by indentations as opposed to drilled holes.

It will be readily recognized that many variations can be made in the embodiments heretofore described without departing from the spirit and scope of the present invention.

What is claimed is:

1. A chance device in combination with lotto game cards of at least two different lotto games, the cards each having a grid bearing a plurality of written numbers, a predetermined number of which are to be selected from the grid by a player in entering one of the lotto games, the device comprising:

six face members joined together in the form of a cube, at least two of the face members of the approximate size of the grids of said two different lotto games, each face member having recessed pockets corresponding in number and positioning to the numbers of the grid of one of the lotto game cards, said at least two of the face members having different patterns of pockets making the game device operable in combination with lotto game cards of said at least two different lotto games;

a group of balls in corresponding number to the predetermined number of numbers to be selected in the lotto games; and, means to keep the balls loosely in the vicinity of the face members, whereby the face members can be shaken and positioned upon the one of the lotto game grids with the pockets corresponding to the numbers of the grid to allow the group of balls to randomly fall into certain of the pockets thus providing a random selection of numbers on the one of the lotto grids.

2. The game device of claim 1 wherein said means to prevent the group of balls from rolling off the face members comprises sides extending upwardly from the face members.

3. The game device of claim 1, wherein at least one of the face members is transparent.

4. The game device of claim 1 wherein the recessed pockets are holes drilled through the face member said holes being of smaller diameter than that of the balls.

5. The game device of claim 1 wherein the group of balls comprises six in number.

6. The game device of claim 1 wherein the face members are bonded together.

7. The game device of claim 1 wherein one of the face members is removable to provide access to the group of balls.

8. A method of playing at least one of two different lotto games, each lotto game requiring a player to select a pre-determined number of entries from a plurality of possible entries printed on a grid of a lotto card, the method comprising the steps of:

shaking a game device cube containing a group of balls corresponding to the number of the lotto numbers to be selected;

selecting one of multiple face members of the game device cube, at least two of said multiple face members each having pockets that are positioned to correspond to the possible entries on the lotto card for one of said two lotto games; and, placing the selected face member in alignment with possible entries on the one of said two lotto cards, whereupon the balls roll into certain pockets designating chosen lotto numbers for the player.

* * * * *